US007074090B2

(12) United States Patent
Ho et al.

(10) Patent No.: US 7,074,090 B2
(45) Date of Patent: Jul. 11, 2006

(54) CARD EDGE CONNECTOR ASSEMBLY

(75) Inventors: Yi-Tse Ho, Tainan County (TW); Katsutoshi Tojo, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/926,511

(22) Filed: Aug. 26, 2004

(65) Prior Publication Data

US 2005/0048828 A1 Mar. 3, 2005

(51) Int. Cl.
*H01R 24/00* (2006.01)

(52) U.S. Cl. ..... 439/630; 439/326

(58) Field of Classification Search ..... 439/74, 439/326, 327, 630, 910

See application file for complete search history.

(56) References Cited

U.S. PATENT DOCUMENTS 6,227,893 B1 * 5/2001 Kaneko ..... 439/326

* cited by examiner

*Primary Examiner*—Khiem Nguyen
(74) *Attorney, Agent, or Firm*—Robert J. Zeitler

(57) ABSTRACT

A card edge connector assembly includes a circuit board, a connector, an electrical card and a fixing structure. The connector is formed on the circuit board, the front rim of the electrical card is inserted into the insertion slot of the connector. The fixing structure has an elastic element having a fixing portion positioned on the circuit board. Two relating opposing sides of the fixing portion extends two elastic arms whose free ends form a beveled edge and a clasp portion, and define positioning slots on the rear rim of the electrical card. The length of the elastic arm increases in such a way that the elasticity of the elastic arm becomes greater so as to prevent the elastic arm abrading and breaking to ensure the positioning function and enhance the shock-resistance.

11 Claims, 8 Drawing Sheets

CARD EDGE CONNECTOR ASSEMBLY

FIELD OF THE INVENTION

The present invention relates to a card edge connector assembly, and more particularly to a card edge connector wherein a fixing structure is separate from a connector.

BACKGROUND OF THE INVENTION

Electrical products include various types of electrical connectors for receiving electrical cards. In order to keep the electrical connection therebetween, the connector and the electrical card must be connected stably. If the connection is not stable, the signals may become intermittent, thereby degrading the performance of the electrical product.

Referring to FIG. 1, a conventional card connector assembly comprises a circuit board 2*a*, a connector 1*a* and an electrical card (not shown). The connector 1*a* is formed on the circuit board 2*a* and comprises an insulative housing 10*a*, a plurality of terminals 11*a* and two metallic rods 12*a*. The insulative housing 10*a* has a base portion 13*a*, and two side frames 14*a* which has two insertion slots 15*a* on two opposite inner sides thereof, extending out from two ends of the base portion. One end of the terminals 11*a* is formed on the base portion 13*a* and the other end is connected to the circuit board 2*a*. The two metallic rods are formed on two corresponding out sides of the two side frames 14*a*. Each of the metallic rods 12*a* has a clip portion 16*a* fixed on the side frame 14*a*, the electrical card plugs into the insertion slot 15*a* of the side frame 14*a* and connects with the terminals 11*a* electrically.

However, when the connector is first fixed on the circuit board, the predetermined space for the connector of the circuit board will affect the circuit layout. Requiring space for the metallic rod 12*a*, side frame 14*a* and clip portion 16*a*, for example, decreases the circuit design flexibility as that structure takes up space on the circuit board that could be put to other uses.

Second, when the electrical card plugs into the insertion slot, the distance between the two side frames limits the width of the electrical card so that the width of the electrical card cannot have variance beyond certain limits.

Furthermore, the two side frames are made of plastic so that it lacks sufficient rigidity. As such, the two side frames may deflect, distort or even break because of the extension of the two side frames during the insertion and removal of the electrical card resulting in loss of the fixing function of the side frames.

In order to solve the above-mentioned problems of the conventional card edge connector assembly, the applicant has proposed a patent application whose application number is TW 91207780, being granted on Jun. 30, 2003. Referring to FIG. 2, the fixing structure of the electrical connector is formed on the circuit board 1 and comprises a connector 2, and electrical card 3 and a clasp element 4. The clasp element 4 and the connector 2 are formed on the circuit board 1 separately. The front rim of the electrical card 3 plugs into the insertion slot 21 of the connector 2, and a hook portion 40 of the clasp element 4 hooks a buckling portion 31 of the electrical card 3 for fixing the electrical card 3.

By means of the clasp element, the design flexibility of the circuit board, the limiting width of the electrical card and the deflection and breakage of the side frame can be solved efficiently. However, as portable electronics become more popular, such as notebook computers, connection between the connector and the electrical card must exhibit greater shock-resistance to satisfy the frequent action and operation. The clasp element of the fixing structure is made of plastic, and the length of the buckling portion is small due to the thin nature of the notebook computer, so that the elasticity of the buckling portion is insufficient. That is, the fixing structure is needs to be improved to decrease the possibility of breakage and abrasion, so as to avoid the electrical problems associated with a loose electrical card.

As can be seen from the above, the conventional card edge connector assembly has some inconvenience and problems in use, and the above-mentioned fixing structure of the electrical card also needs to be improved.

SUMMARY OF THE INVENTION

One object of the present invention is to provide a card edge connector assembly in which abrasion and breakage of the fixing structure is reduced, the positioning of the electrical card is firmer, and the shock-resistance of the connection between the electrical card and the connector is increased.

Another object of the present invention is to provide a card edge connector assembly in which the fixing structure and the connector are formed on the circuit board separately, the design space of the electrical card is extended, and the design flexibility of the circuit board is enhanced.

Still another object of the present invention is to provide a card edge connector assembly in which the electrical card is disassembled quickly and easily.

To achieve the above objects, a card edge connector assembly of the present invention comprises a circuit board, a connector, an electrical card and a fixing structure. The connector has an insertion slot and is formed on the circuit board. The electrical card has a front rim and a rear rim opposite to each other, and the front rim plugs into the insertion slot. The fixing structure has an elastic element having a fixing portion positioned on the circuit board. Two elastic arms extend from two opposite sides of the fixing portion. Free ends of the two elastic arms form two beveled edges and two clasp portions. The two beveled edges are close to the circuit board and define positioning slots with the two clasp portions respectively to fix the rear rim of the electrical card.

The lengths of the elastic arms of the elastic element of the fixing structure increase in such a way that the elasticity becomes greater so as to avoid abrasion and breakage for insufficient elasticity of the elastic element. The size of the electrical card can be increased and the design of the circuit board becomes more flexible in a manner that the fixing structure and the connector are formed on the circuit board separately. Operation of the electrical card is simplified, and the electrical card is easily disassembled because of the good elasticity of the elastic arms.

The present invention may also include a beveled edge and the clasp portion of the elastic arm to limit the electrical card movement in an upward and downward direction, and a protrusion of the fixing portion of the elastic element abuts against the rear rim of the electrical card to limit the electrical card movement laterally, and the limiting surfaces in the positioning slot of the elastic arm limits the lateral movement of the electrical card. This structure increases the shock resistance of the fixing structure and ensures the electrical contact between the electrical card and the connector.

The fixing structure may further comprise a stop plate, wherein a rear stop piece of the stop plate and the elastic arm define a gap to provide a retracting distance for the elastic arm so as to prevent the elastic arm from breaking from being overextended when it is pulled backwardly.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
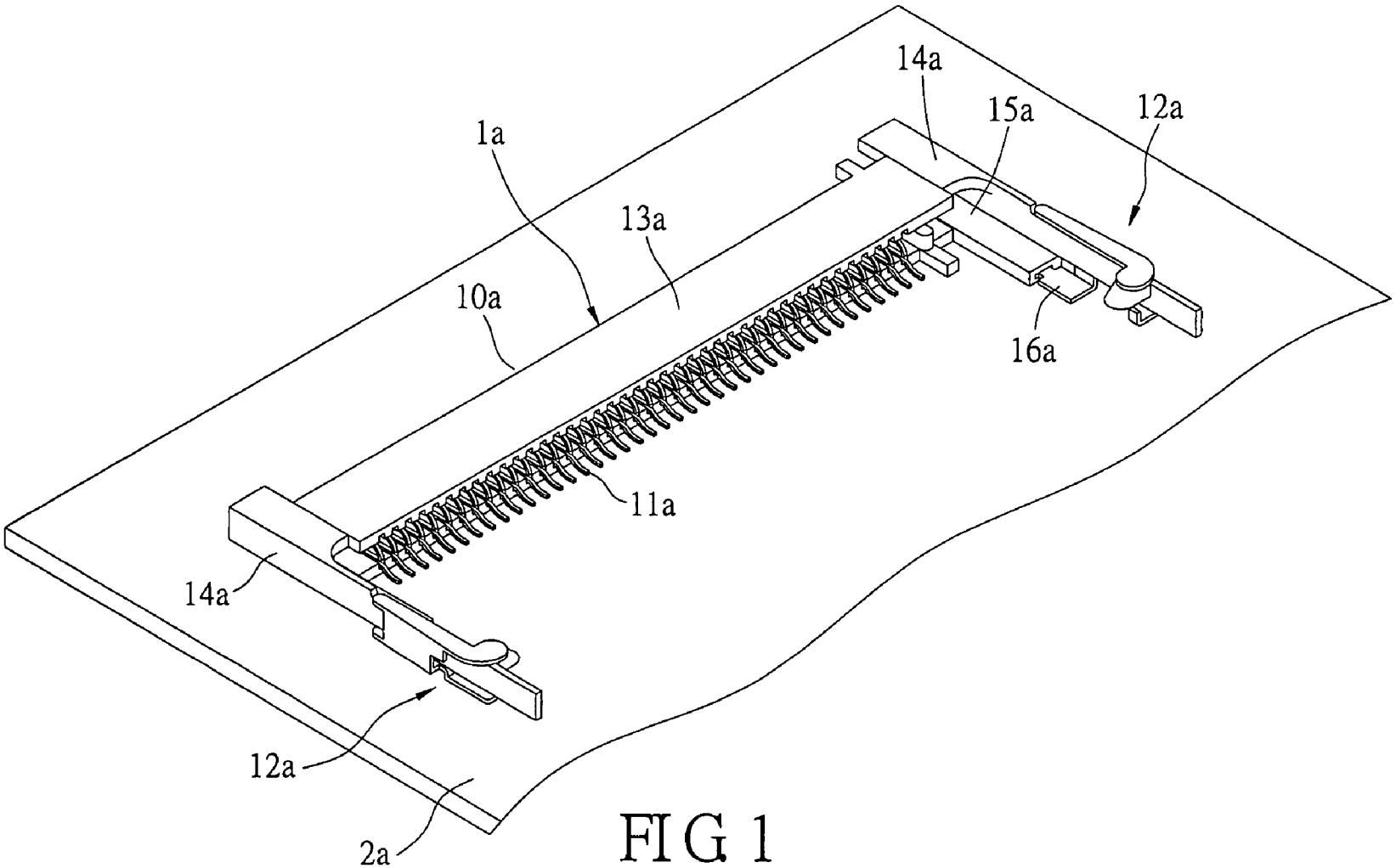
FIG 1 PRIOR ART
FIG. 1 is a perspective view of a known card edge connector assembly.
Figure 2:
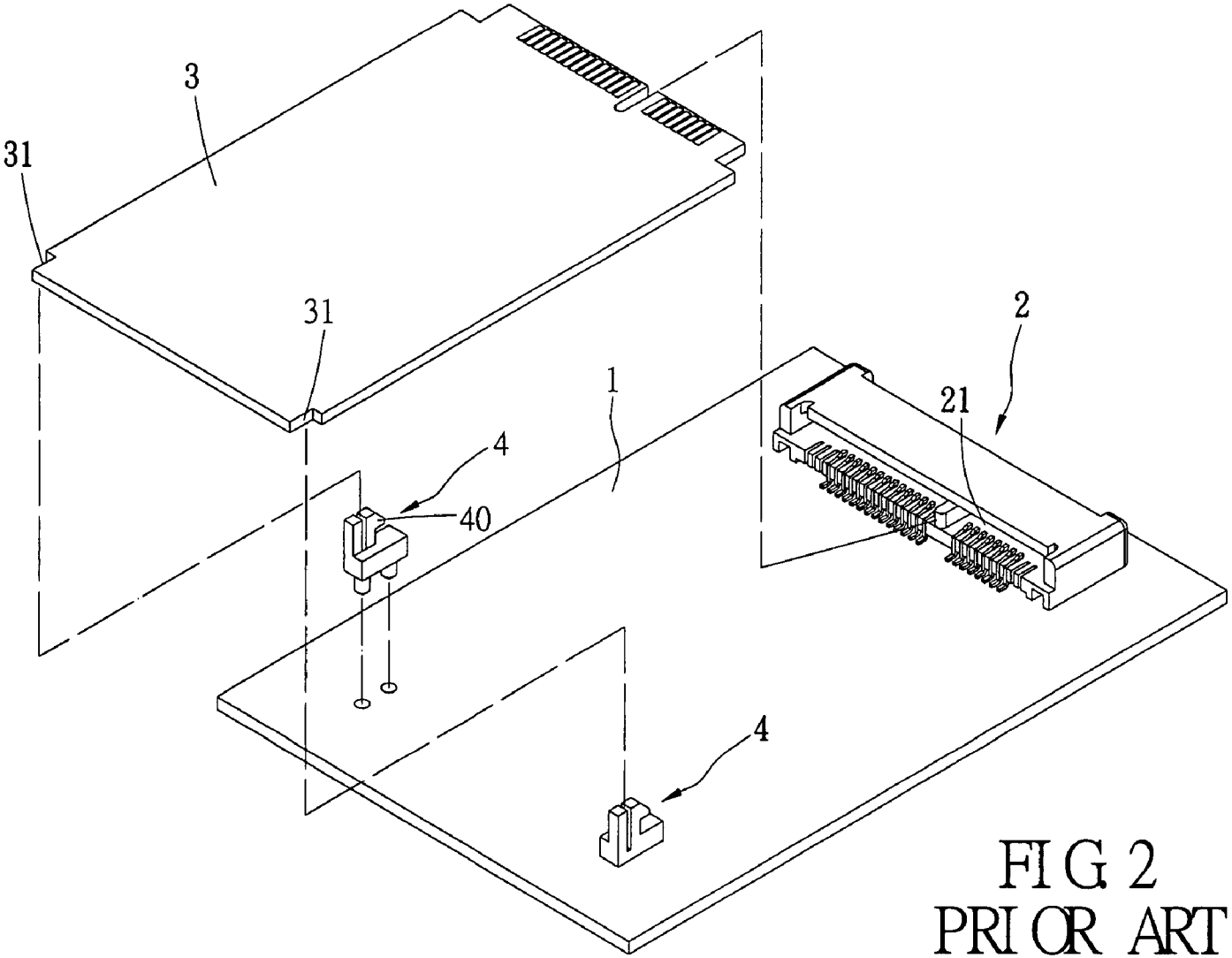
FIG 2 PRIOR ART
FIG. 2 is a perspective view of another known card edge connector assembly.
Figure 3:
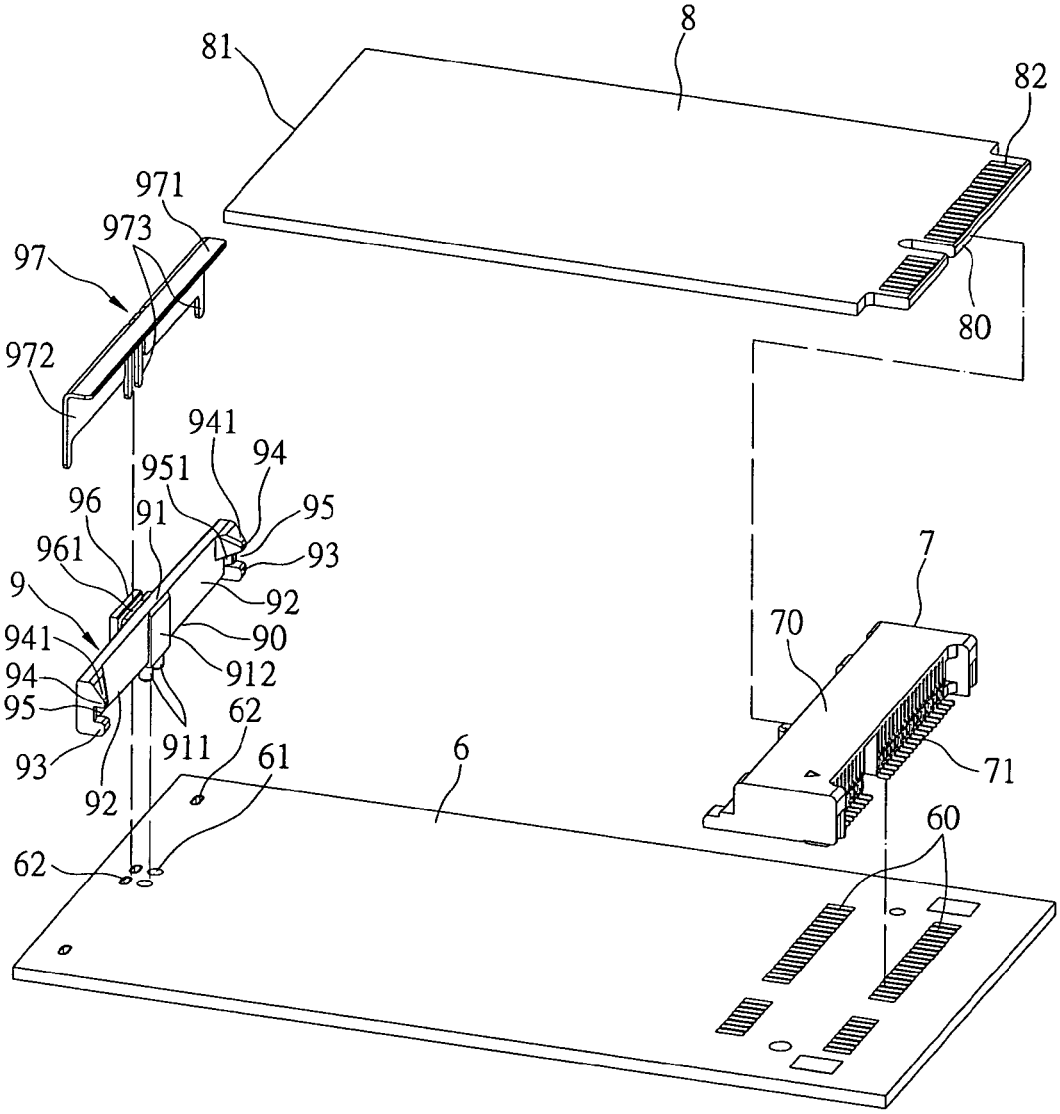
FIG. 3 is an exploded, perspective view of a first embodiment of the present invention.
Figure 4:
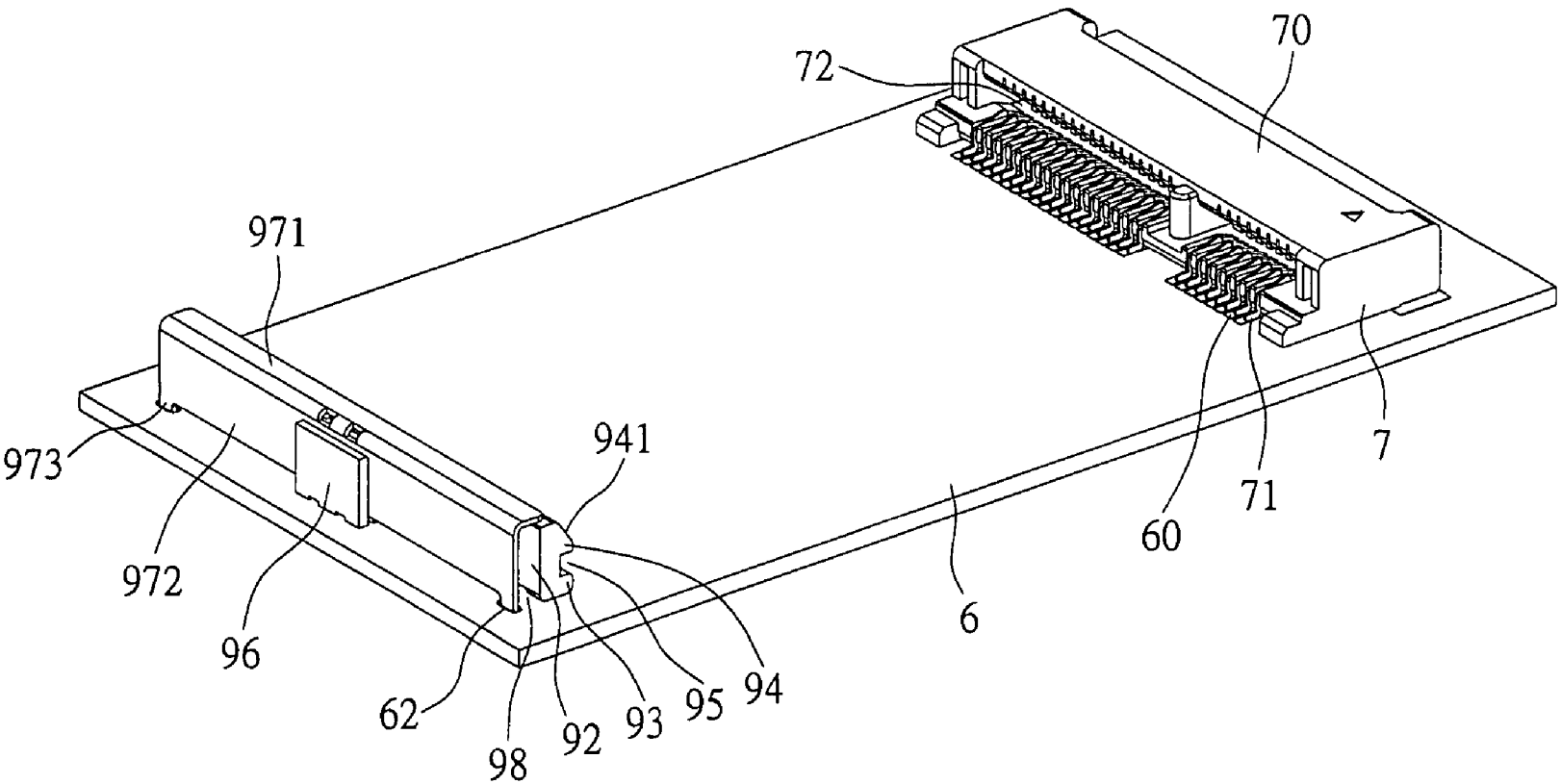
FIG. 4 is an assembled, perspective view of the first embodiment of the present invention without an electrical card plugged thereinto.
Figure 5:
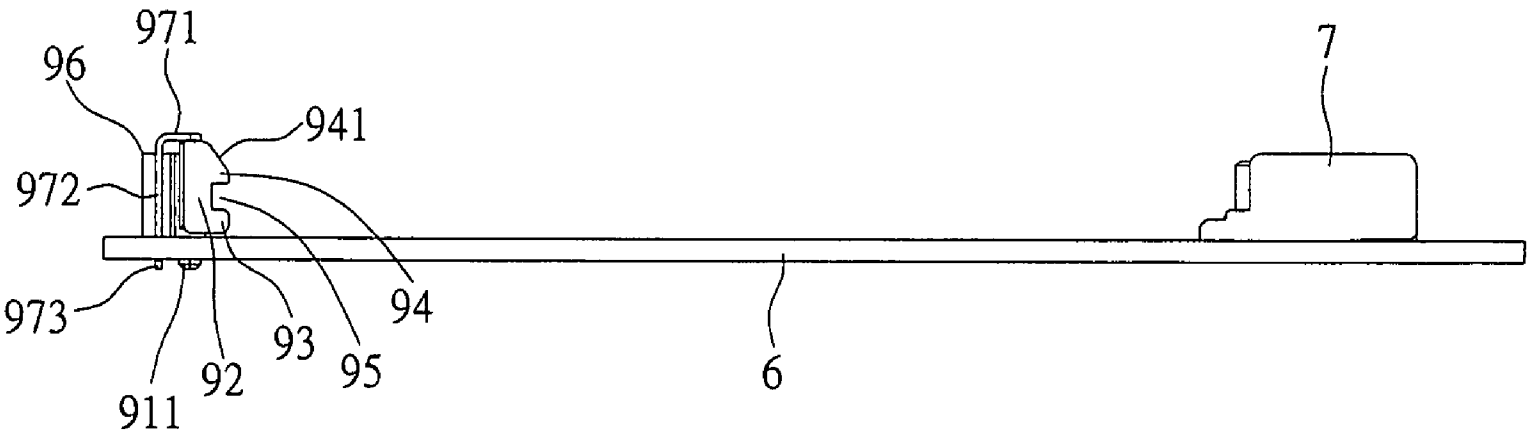
FIG. 5 is a side view of the first embodiment of the present invention without the electrical card plugged thereinto.
Figure 6:
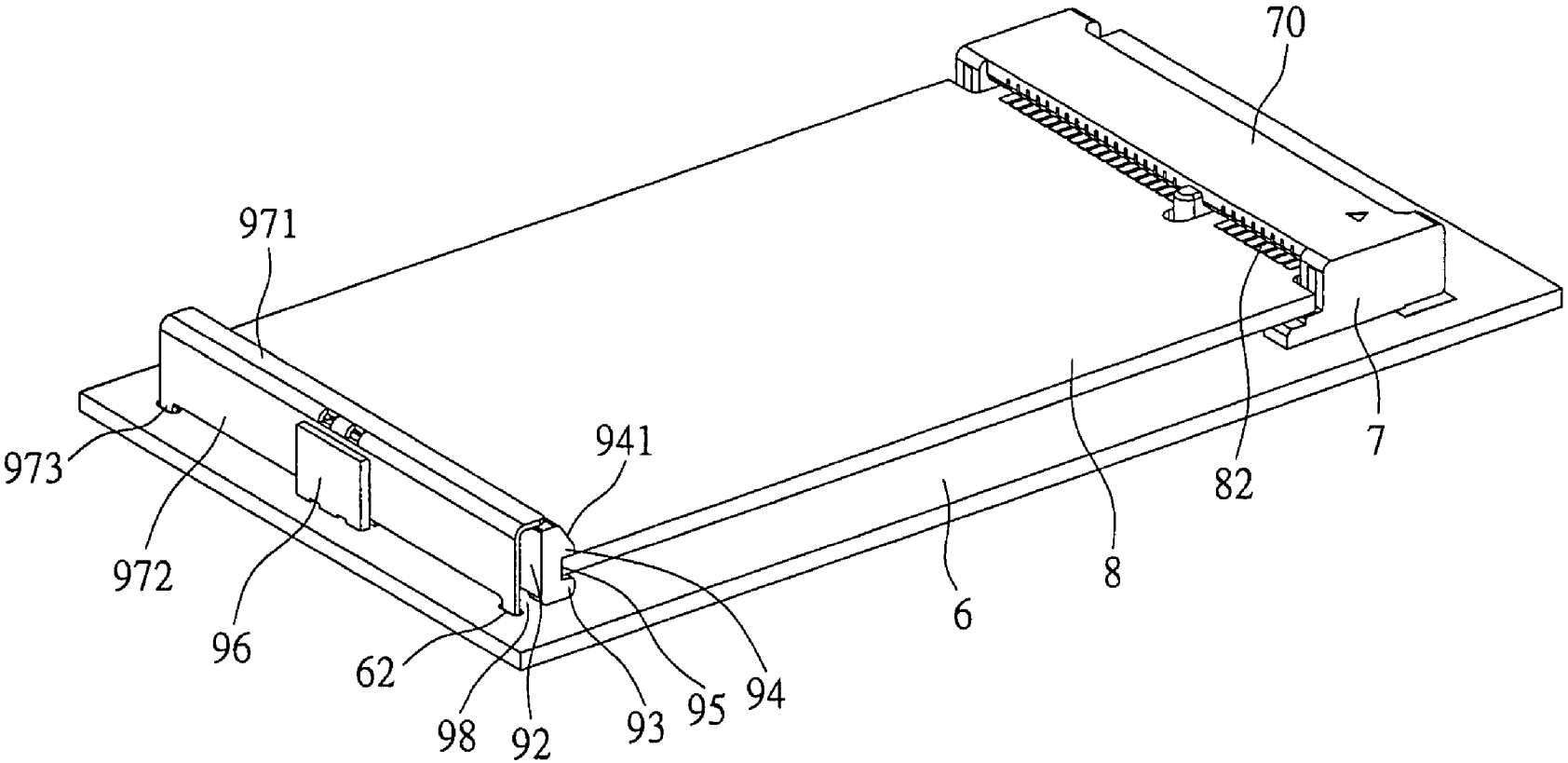
FIG. 6 is an assembled, perspective view of the first embodiment of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Referring to FIGS. 3–6, a card edge connector assembly of the present invention comprises a circuit board 6, a connector 7, an electrical card 8 and a fixing structure 9. The circuit board 6 comprises a plurality of conductive contact pads 60 and a positioning hole 61.

The connector 7 is mounted on the circuit board 6 and comprises an insulative housing 70 and a plurality of terminals 71. An inner rim of the insulative housing 70 has an insertion slot 72, and one end of each of the terminals 71 is connected to the conductive point 60 of the circuit board 6, and the other end is inserted into the insertion slot 72.

The electrical card 8 comprises a front rim 80 and a rear rim 81 opposite to each other. The front rim 80 has a plurality of conductive portions 82 and plugs into the insertion slot 72 in such a manner that the conductive portions 82 electrically contact the terminals 71 of the insertion slot 72.

The fixing structure 9 has an elastic element 90 made of plastic. The elastic element 90 forms a fixing portion 91 having a positioning post inserted into the positioning hole 61 of the circuit board 6 to make the fixing portion 91 position on the circuit board 6. Two relating opposite sides of the fixing structure 91 extend elastic arms 92 of which free ends form a beveled edge 93 and a clasp portion 94 respectively. The two beveled edges 93 are close to the circuit board 6, and the two clasp portions 94 form inclined surfaces 941 on a top surface thereof facing the connector 7. The two beveled edges 93 define positioning slots 95 with the two clasp portions 94 respectively so as to fix the rear rim 81 of the electrical card 8 within the positioning slots 95. The free ends of the two elastic arms 92 form two opposing limiting surfaces 951 positioned in the two positioning slots 95, respectively, in such a manner that two end corners of the rear rim 81 of the electrical card 8 are positioned between the two limiting surfaces 951 respectively, and the fixing portion 91 of the elastic element 90 forms a protrusion 912 abutting against the rear rim 81 of the electrical card 8 at the same time.

The electrical card 8 defines an angle with regard to the circuit board 6 to plug the front rim 80 of the electrical card 8 into the insertion slot 72 of the connector 7, then presses the rear rim 81 of the electrical card 8 downwardly and open the elastic arms 92 along the incline surface 941 of the clasp portion 94 to position the rear rim 81 of the electrical card 8 in the positioning slot 95. Because the length from the fixing portion 91 to the free end is relatively long, the elasticity of the elastic arm 92 becomes greater due to the cantilever beam aspect of the elastic arms 92. This makes the pressing operation and the retracting operation of the elastic arm 92 easier so that the elastic arm 92 won't break because of insufficient elasticity and too hard of a material thereof. Additionally, it also won't be abraded because of a too soft of the material thereof required to get the desired elasticity in a system with shorter arms so as to ensure the positioning function of the fixing structure 9. The beveled edge 93 of the elastic element 90 is used to prevent the electrical card 8 being pressed too downwardly and mate with the clasp portion 94 to limit the electrical card move up and down. The protrusion 912 of the elastic element 90 abuts against the rear rim 81 of the electrical card 8 to compensate the gap between the elastic element 90 and the electrical card 8 so as to prevent the electrical card 8 separating from the insertion slot 72 when the electrical card moves backward because of shock, and keeps the front rim 80 of the electrical card 8 contacting electrically with the terminals 71 of the connector 7.

Two opposing limiting surfaces 951 in the insertion slot 95 of the elastic arm 92 guides the two end corners of the rear rim 81 of the electrical card 8 to position between the two limiting surfaces 951 so as to prevent the electrical card 8 from moving laterally, i.e., from left to right. Thus, the elastic arm 92 has a good positioning function, good elasticity, and the elastic arm 92 mates with the protrusion 912 and the limiting surfaces 951 in such a manner that the electrical card 8 is positioned in all directions and can bear shock loads due to its high shock-resistance.

Additionally, the fixing structure 9 is formed separately from the connector 7 in such a manner that the design space of the electrical card 8 can be extended to two sides according to the demand so that the design of the circuit board 6 is not restrained and the whole function of the electrical card 8 can be enhanced. And when the edge card connector assembly needs to be maintained, the electrical card 8 is released by pulling the elastic arm 92 backwardly, so that it can be disassembled easily and quickly.

An insertion portion 96 is formed on the fixing portion 91 relating to the opposite side of the electrical card 8. The insertion portion 96 has an insertion hole 961, the circuit board further comprises a through hole 62 and the fixing structure 9 further comprises a stop plate 97 made of metallic material whose rigidity is greater than that of the elastic element 90. The stop plate 97 has a top stop piece 971 and a rear stop piece 972, and the top stop piece 971 is positioned on the top surface of the fixing portion 91 and the elastic arm 92. Two ends of the rear stop piece 972 and a place thereof relating to the insertion hole 961 of the insertion portion 96 form downwardly extending positioning legs 973. The positioning legs 973 located near the positioning holes are inserted into the insertion hole 961 and the through hole 62 of the circuit board 6 and are fixed on the circuit board 6. The rear stop piece 972 and the elastic arm 92 define a gap therebetween to provide a retracting distance for the elastic arm 92 and prevent the elastic arm 92 from overextending rearwardly when it is pulled backwardly.

In the first embodiment of the present invention, the fixing portion 91 and the elastic arm 92 of the elastic element 90 have a height dimension the same as the clasp portion 94 of the free end. The top stop piece 971 of the stop plate 97 is positioned from the top surfaces of the fixing portion 91 and the elastic arm 92 to the top surface of the clasp portion 94.

Figure 7:
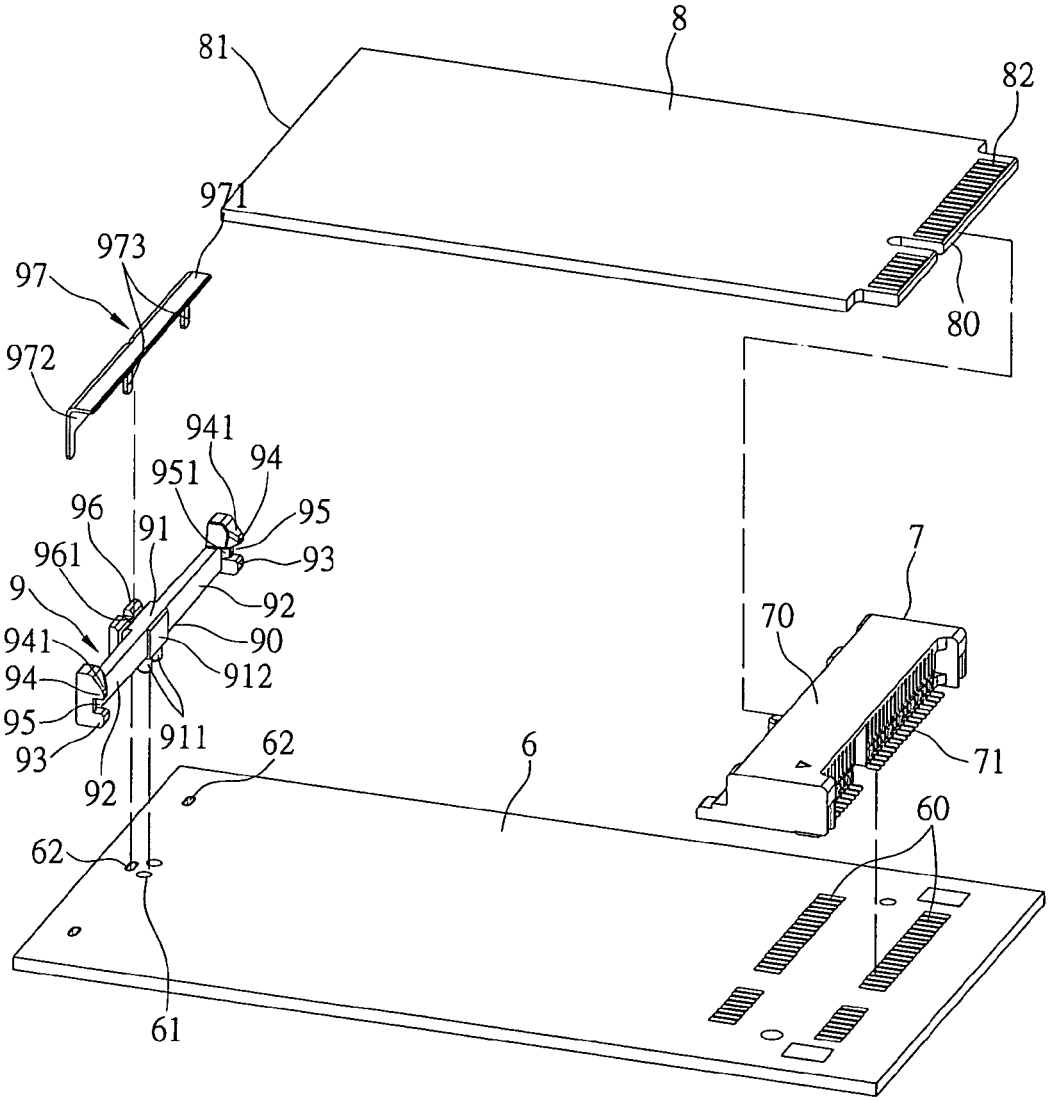
FIG. 7 is an exploded, perspective view of a second embodiment of the present invention.
Figure 8:
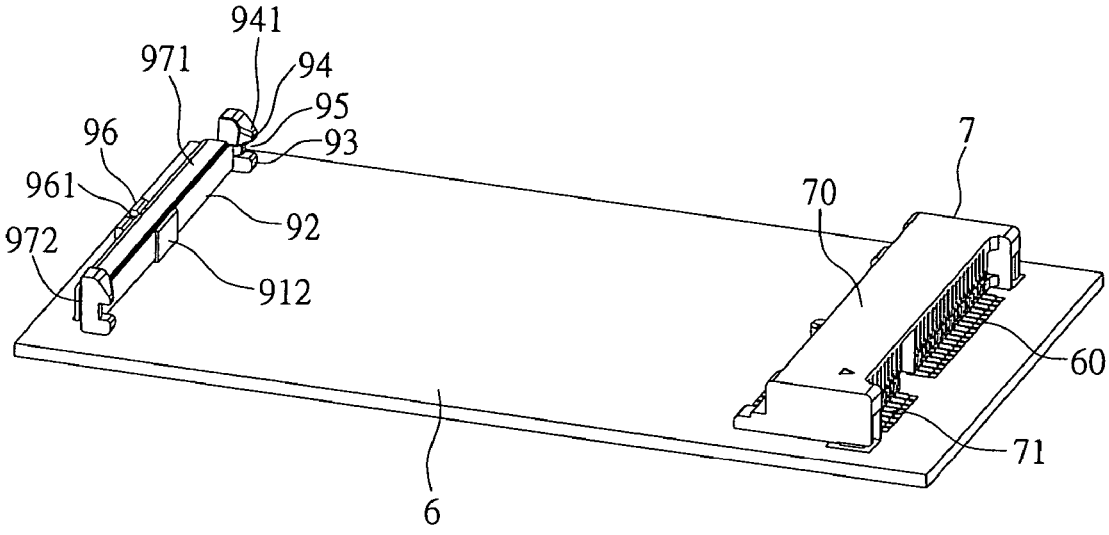
FIG. 8 is an assembled, perspective view of the second embodiment of the present invention without an electrical card plugged thereinto.

Referring to FIGS. 7–8, in a second embodiment of the present invention, the fixing portion 91 and the elastic arm 92 are lower than the clasp portion 94 of the free end of the elastic arm 92. The top stop piece 971 of the stop plate 97 is positioned on the top surfaces of the fixing portion 91 and the elastic arm 92 which are close to the positioning slot 95 and between the two clasp portion 94. This can save space and material cost for the low height of the top stop piece positioned.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A card edge connector assembly capable of being mounted on a circuit board for receiving an electrical card having a front rim and a rear rim opposite to each other, comprising:

a connector formed on the circuit board and having a insertion slot; and a fixing structure having an elastic element which has a fixing portion positioned on the circuit board, wherein two elastic arms extend from two relating sides of the fixing portion, free ends of the two elastic arms form a beveled edge and a clasp portion, the two beveled edges are close to the circuit and define positioning slots with the two clasp portions respectively to fix the rear rim of the electrical card.

2. The card edge connector assembly as claimed in claim 1, wherein the circuit board has a plurality of conductive contact pads, the connector comprises an insulative housing of which an inner rim has said insertion slot and a plurality of terminals of which one end connects with the conductive contact pads electrically, and the other end plugs into the insertion slot, the front rim of the electrical card forms a plurality of conductive portion contacting the terminals in the insertion slot electrically.

3. The card edge connector assembly as claimed in claim 1, wherein the fixing portion of the elastic element forms a positioning post, the circuit board forms positioning a hole, the positioning post inserts into the positioning hole.

4. The card edge connector assembly as claimed in claim 1, wherein the free ends of the two elastic arms form two opposite limiting surface in the two positioning slots respectively, corners of two ends of the rear rim of the electrical card are positioned between the two limiting surface respectively.

5. The card edge connector assembly as claimed in claim 1, wherein the fixing portion of the elastic element forms a protrusion abutting against the rear rim of the electrical card.

6. A card edge connector assembly capable of being mounted on a circuit board for receiving an electrical card having a front rim and a rear rim opposite to each other, comprising:

a connector formed on the circuit board and having a insertion slot; and a fixing structure having an elastic element which has a fixing portion positioned on the circuit board, wherein two elastic arms extend from two relating sides of the fixing portion, free ends of the two elastic arms form a beveled edge and a clasp portion, the two beveled edges are close to the circuit and define positioning slots with the two clasp portions respectively to fix the rear rim of the electrical card, wherein the fixing portion of the elastic element further comprises a insertion portion relating to an opposite side of the electrical card, the insertion having insertion holes, the circuit board further comprises a through hole, the fixing structure further comprises a stop plate having a top stop piece and a rear stop piece, the top stop piece positioned on top surfaces of the fixing portion and the elastic arm, two ends of the rear stop piece and the insertion holes relating to the insertion portion form a positioning leg downwardly, the positioning leg inserting into the insertion holes and the through hole of the circuit board and fixed on the circuit board, the rear stop piece and the elastic arm define a gap to provide a retracting distance for the elastic arm.

7. The card edge connector assembly as claimed in claim 6, wherein the fixing portion of the elastic element and the elastic arm have a height same as that of the clasp portion of the free ends, the top stop piece of the stop plate positioned on the top surface of the fixing portion and the elastic arm to the top surface of the clasp portion.

8. The card edge connector assembly as claimed in claim 1, wherein the top surface of the clasp portion of the elastic element forms a incline surface facing the connector.

9. A card edge connector assembly capable of being mounted on a circuit board for receiving an electrical card having a front rim and a rear rim opposite to each other, comprising:

a connector formed on the circuit board and having a insertion slot; and a fixing structure having an elastic element which has a fixing portion positioned on the circuit board, wherein two elastic arms extend from two relating sides of the fixing portion, free ends of the two elastic arms form a beveled edge and a clasp portion, the two beveled edges are close to the circuit and define positioning slots with the two clasp portions respectively to fix the rear rim of the electrical card, wherein the fixing structure further comprises a stop plate having a top stop piece and a rear stop piece, the top stop piece positioned on top surfaces of the fixing portion and the elastic arm.

10. The card edge connector assembly as claimed in claim 9, wherein the rear stop piece includes a plurality of downwardly projecting positioning legs.

11. The card edge connector assembly as claimed in claim 9, wherein the rear stop piece and the elastic arm define a gap therebetween to provide a retracting distance for the elastic arm.

* * * * *